US010024158B2

(12) United States Patent
Hofmann et al.

(10) Patent No.: US 10,024,158 B2
(45) Date of Patent: Jul. 17, 2018

(54) HYDROSTATIC POSITIVE DISPLACEMENT MACHINE

(71) Applicant: Linde Hydraulics GmbH & Co. KG, Aschaffenburg (DE)

(72) Inventors: Richard Hofmann, Alzenau (DE); Martin Bergmann, Schaafheim (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 296 days.

(21) Appl. No.: 13/910,258

(22) Filed: Jun. 5, 2013

(65) Prior Publication Data

US 2014/0150640 A1 Jun. 5, 2014

(30) Foreign Application Priority Data

Jun. 6, 2012 (DE) ..... 10 2012 104 923

(51) Int. Cl.
*F01B 3/00* (2006.01)
*F04B 1/30* (2006.01)
*F04B 1/20* (2006.01)

(52) U.S. Cl.
CPC ..... *F01B 3/0035* (2013.01); *F04B 1/2021* (2013.01); *F04B 1/2042* (2013.01); *F04B 1/306* (2013.01)

(58) Field of Classification Search
CPC .. F04B 1/12; F04B 1/20; F04B 1/2007; F04B 1/2021; F04B 1/2042; F04B 1/30;
(Continued)

(56) References Cited

U.S. PATENT DOCUMENTS 3,063,470 A * 11/1962 Forster ..... F16L 55/052 138/30
3,120,814 A * 2/1964 Mueller ..... F04B 1/2042 417/310

(Continued)

FOREIGN PATENT DOCUMENTS

CN 101949373 A 1/2011
DE 19706114 A1 8/1998

(Continued)

OTHER PUBLICATIONS

DE102012202038A1—English Translation.*

*Primary Examiner* — Devon Kramer
*Assistant Examiner* — Christopher Brunjes
(74) *Attorney, Agent, or Firm* — The Webb Law Firm

(57) ABSTRACT

A hydrostatic positive displacement machine has a cylinder drum (4) located in a housing (9) and rotatable around an axis of rotation (2). During rotation of the cylinder drum (4), a piston bore (5) is placed in alternating communication with an inlet side (E) and an outlet side (A). The inlet side (E) and outlet side (A) comprise connections (21; 22) to a control plate (12). A reversing device (30) is located in a reversing area (25; 26) between the connections (21, 22) on the control plate (12). The reversing device (30) damps the pressure adjustment between a displacement chamber (V) and the pressure present in the connection (21; 22). The reversing device (30) includes at least two flow connections which are actuated simultaneously by the displacement chamber (V) as it moves along the reversing area (25; 26).

7 Claims, 10 Drawing Sheets

(58) Field of Classification Search
CPC ..... F04B 1/303; F04B 3/00; F04B 3/0032; F04B 3/0041; F04B 3/0047
USPC ..... 417/222.1, 222.2, 269–272
See application file for complete search history.

(56) References Cited

U.S. PATENT DOCUMENTS

| | | | | | |
|---|---|---|---|---|---|
| 6,086,336 | A * | 7/2000 | Welschof | ..... | F04B 1/2042 417/308 |
| 6,442,934 | B1 * | 9/2002 | Okuda | ..... | F04B 49/002 60/451 |
| 2010/0000401 | A1 * | 1/2010 | Beck | ..... | F04B 1/2021 92/12.2 |

FOREIGN PATENT DOCUMENTS

| | | | | | |
|---|---|---|---|---|---|
| DE | 102012202038 | A1 * | 8/2013 | ..... | B01D 35/14 |
| JP | 1182290 | A | 3/1999 | | |
| JP | 200365215 | A | 3/2003 | | |
| JP | 2011236847 | A | 11/2011 | | |

* cited by examiner

HYDROSTATIC POSITIVE DISPLACEMENT MACHINE

CROSS REFERENCE TO RELATED APPLICATION

This application claims priority to German Application DE 102012104923.8 filed on Jun. 6, 2012, which is herein incorporated by reference in its entirety.

BACKGROUND OF THE INVENTION

Field of the Invention

This invention relates to a hydrostatic positive displacement machine with a cylinder drum positioned so that it can rotate around an axis of rotation and which is provided with at least one piston bore in which a piston is positioned so that it can be displaced longitudinally. During the rotation of the cylinder drum, the piston bore is placed in communication alternately with an inlet side and an outlet side. The inlet side and the outlet side comprise connections to a control plate and, located in the reversal area between the connections to the control plate, is a reversal device which damps the pressure adjustment between the displacement chamber and the pressure present in the connection by means of a volume flow into or out of the displacement chamber formed by the piston and the piston bore.

Description of Related Art

On hydrostatic positive displacement machines of this type, when the cylinder drum rotates around the axis of rotation, the piston bores, which form corresponding displacement chambers filled with hydraulic fluid, reverse from the inlet side to the outlet side. The inlet side and the outlet side are in communication via corresponding connections with a control plate with which the cylinder drum is in contact. The piston bores are each provided with a corresponding connection opening, by means of which the piston bore actuates the connections in the control plate.

Because in the operation of the positive displacement machine different pressures are present on the inlet side and the outlet side, when there is a pressure reversal in the piston bore, high volume flows occur when the displacement chamber comes into communication with the corresponding connection on account of the elasticity of the hydraulic fluid and the pressure difference between the displacement chamber and the corresponding connection in the control plate. To prevent high pressure peaks in the communication of the displacement chamber with the connection, it is known that a reversing device can be located in the reversing area between the connections of the control plate, by means of which, when a pressure increase in the displacement chamber is required, hydraulic fluid under pressure is transported to the displacement chamber, or when a pressure decrease in the displacement chamber is required, hydraulic fluid under pressure is removed from the displacement chamber. Reversal devices of this type thereby make it possible, by means of a volume flow into the displacement chamber or out of the displacement chamber, to adjust the pressure between the displacement chamber formed by the piston bore and the connection, so that as a result of the pressure adjustment between the displacement chamber and the pressure that is present in the connection, the existing pressure differences can be damped during the reversal of the displacement chamber into the connection.

A hydrostatic positive displacement machine is described in DE 197 06 114 C2. The reversing device is formed by a hydraulic buffer which comes into communication with the displacement chamber by means of one or more connecting borings which are located on the control plate in the reversing area between the two connections. The connecting borings make it possible to add and remove hydraulic fluid to and from the displacement chamber by means of an appropriately sized cross section that damps the volume flow, so that by means of a damped pressure decrease or pressure increase in the displacement chamber, high pressure peaks can be prevented when the displacement chamber comes into communication with the corresponding connection.

In DE 197 06 114 C2, a plurality of connecting borings in the reversal area—viewed in the direction of movement of the cylinder drum—can be arranged behind one another and therefore sequentially are opened in a chronological sequence one after another during a rotation of the cylinder drum along the reversal area of the connection opening of the piston bore. The plurality of connecting openings makes possible a controlled enlargement of the opening cross section formed by the individual connection openings.

As a rule, the volume flows through these connecting borings of the reversing device are high, such that the pressure of the hydraulic fluid in the damping cross sections of the connecting borings decreases so that cavitation occurs and corresponding cavitation bubbles are formed in the hydraulic fluid. When there is a subsequent pressure increase in the direction of flow of the connecting borings, these cavitation bubbles re-form implosively with a corresponding generation of noise. In the vicinity of material surfaces, for example on the control plate or the cylinder drum, the material surfaces can be damaged by the implosion pressures such that an erosion of material occurs which reduces the service life of the positive displacement machine. The amount of this material erosion caused by the cavitating flows in the connecting borings of the reversing device is proportional to the square of the cross section of the connecting boring and therefore to the fourth power of the diameter of the connecting boring.

Because the cross sectional area of the connecting boring of the reversing device must be designed so that the desired pressure adjustment of the pressure in the displacement chamber is achieved by means of a corresponding volume flow, in known reversing devices with individual connecting borings arranged one behind another in the direction of movement of the cylinder drum, a high degree of material erosion occurs on account of the necessary diameter of the individual connecting borings as a result of the jet cavitation in the connecting borings.

SUMMARY OF THE INVENTION

An object of this invention is to provide a hydrostatic displacement unit of the general type described above but in which the material erosion caused by the cavitating flows of the reversing device and the noises caused by the cavitating flows are reduced.

This object can be accomplished by a reversing device that has at least two flow connections which are actuated simultaneously by the displacement chamber as it moves along the reversing area. The invention takes advantage of the fact that the material erosion is a function of the cross sectional area of the reversing device. If a defined cross sectional area of the reversing device is required for a damped flow of hydraulic fluid and volume flow to control the pressure of the displacement chamber, the invention teaches that it is advantageous to divide this required cross sectional area into at least two and therefore a plurality of flow connections which are actuated simultaneously by the displacement chamber as it moves along the reversing area. The invention therefore teaches that the plurality of flow connections can be provided with smaller opening cross sections, whereby the necessary total cross sectional area of the reversing device is determined by the number of flow connections opened simultaneously. The material erosion is thereby significantly reduced because the amount of the material erosion, given a constant total cross sectional area, is inversely proportional to the number of flow connections actuated simultaneously. Therefore, with a constant total cross sectional area, the material erosion can be reduced by increasing the number of flow connections that are actuated simultaneously with correspondingly smaller individual opening cross sections. By dividing the required total cross sectional area of the reversing device to control the pressure of the displacement chamber into a plurality of flow connections, each with a reduced cross sectional area, which are simultaneously actuated and opened by the displacement chamber, the cavitation erosion and the noise generated by the cavitation and thus the noise emitted by the positive displacement machine can be reduced.

In one advantageous embodiment of the invention, the flow connections to the control plate are located on a contour line which corresponds to the leading edge of a connecting opening of the displacement chamber. With an arrangement of the plurality of flow connections of this type, it is easily possible for the flow connections, as the displacement chamber moves along the reversing area toward the connection, to be actuated and thus opened simultaneously by the leading-edge of the displacement chamber.

An arrangement of this type can be achieved easily if, as in one advantageous configuration of the invention, the flow connections are located on different reference diameters on the control plate in the radial direction, so that the displacement chamber, as it moves along the control plate, opens the flow connections simultaneously with the leading-edge of the connecting opening. With an arrangement of the flow connections on different reference diameters, it is easily possible for the displacement chamber to simultaneously actuate and this open a plurality of flow connections simultaneously with the leading edge of the connecting opening, as it rotates along the reversing area toward the connection.

In one development of the invention, the reversing device has at least one additional flow connection and the flow connections are located one behind another in the direction of movement of the displacement chamber. The reversing device therefore also has flow connections which are actuated and opened one after another by the displacement chamber as it rotates and thus moves along the reversing area. It is consequently possible to achieve a controlled enlargement of the opening cross section of the reversing device.

It is particularly advantageous if the flow connections are distributed on the control plate in the peripheral direction and in the radial direction such that the displacement chamber, as it moves along the control plate, opens at least two flow connections simultaneously and at least one additional flow connection with some delay. This achieves a reversing device of the invention in which the individual opening cross section is formed by the flow connections simultaneously actuated one after another as the displacement chamber moves along the reversing area with the connection.

With the invention, the configuration of the individual opening cross sections and thus the configuration of the flow connections can be any desired shape.

In one advantageous realization of the invention, the flow connections are each in the form of a nozzle bore. Nozzle bores of this type can be created easily.

In an alternative realization of the invention, the flow connections are each in the form of a nozzle notch.

The nozzle bores or the nozzle notches are advantageously realized in the control plate. In this manner, a reversing device which is active in the reversing area between the connections can be formed easily.

In one advantageous realization of the invention, the reversing device is in the form of a screen-like or grid-like structure with a plurality of pores, wherein the pores each form a flow connection. With a screen-like or grid-like structure of the reversing device, a further reduction of the material erosion can be achieved, because with the structure of this type the number of individual flow connections formed by the pores can be significantly increased in a simple manner.

In one configuration of the invention, the screen-like or grid-like structure can be in the form of a fabric, in particular a mesh fabric.

In an additional embodiment of the invention, the screen-like or grid-like structure can consist of a sheet or plate that is provided with perforations. A grid of this type in the form of a screen-like or grid-like structure can easily be manufactured from a sheet or plate in which the perforations can be produced using a laser process, for example.

The reversing device can in this case comprise a single screen-like or grid-like structure, or a plurality of screen-like or grid-like structures can be arranged one after another in the direction of flow of the reversing device and therefore a plurality of screen-like or grid-like structures can be stacked in the direction of flow.

In an additional advantageous embodiment of the invention, the reversing device is formed from a high-porosity material with a plurality of pores, whereby each of the pores forms a flow connection. With a high-porosity material of this type, a significant reduction of material erosion can be achieved because with a high-porosity material it is easily possible to significantly increase the number of flow connections formed by the pores. With a high-porosity material of this type, the pores are formed by corresponding spaces in the foam-like material, which act like small individual flow connections and therefore opening cross sections.

In one advantageous embodiment of the invention, the high-porosity material is in the form of an open-pore metal foam, in particular high-porosity sinter material. With a metal foam of this type, it is easily possible to create a reversing device of the invention with a high number of individual small flow connections.

In one advantageous embodiment of the invention, the screen-like or grid-like structure or the high-porosity material are in the form of an insert which is located in a boring of the control plate. An insert of this type can be easily located and fastened in a boring of the control plate to form the reversing device of the invention.

The flow connections of the reversing device of the invention can be in communication with that connection in which the displacement chamber reverses as it moves along the reversing area and thus with the inlet side or the outlet side of the positive displacement machine.

Alternatively, the flow connections of the reversing device of the invention can be in communication with a hydraulic fluid buffer.

The positive displacement machine is advantageously in the form of an axial piston machine. The positive displacement machine can be in the form of a pump or motor.

BRIEF DESCRIPTION OF THE DRAWINGS

Additional advantages and details of the invention are explained in greater detail below with reference to the exemplary embodiments illustrated in the accompanying schematic figures, in which like reference numbers identify like parts throughout.

DESCRIPTION OF THE PREFERRED EMBODIMENTS

Figure 1:
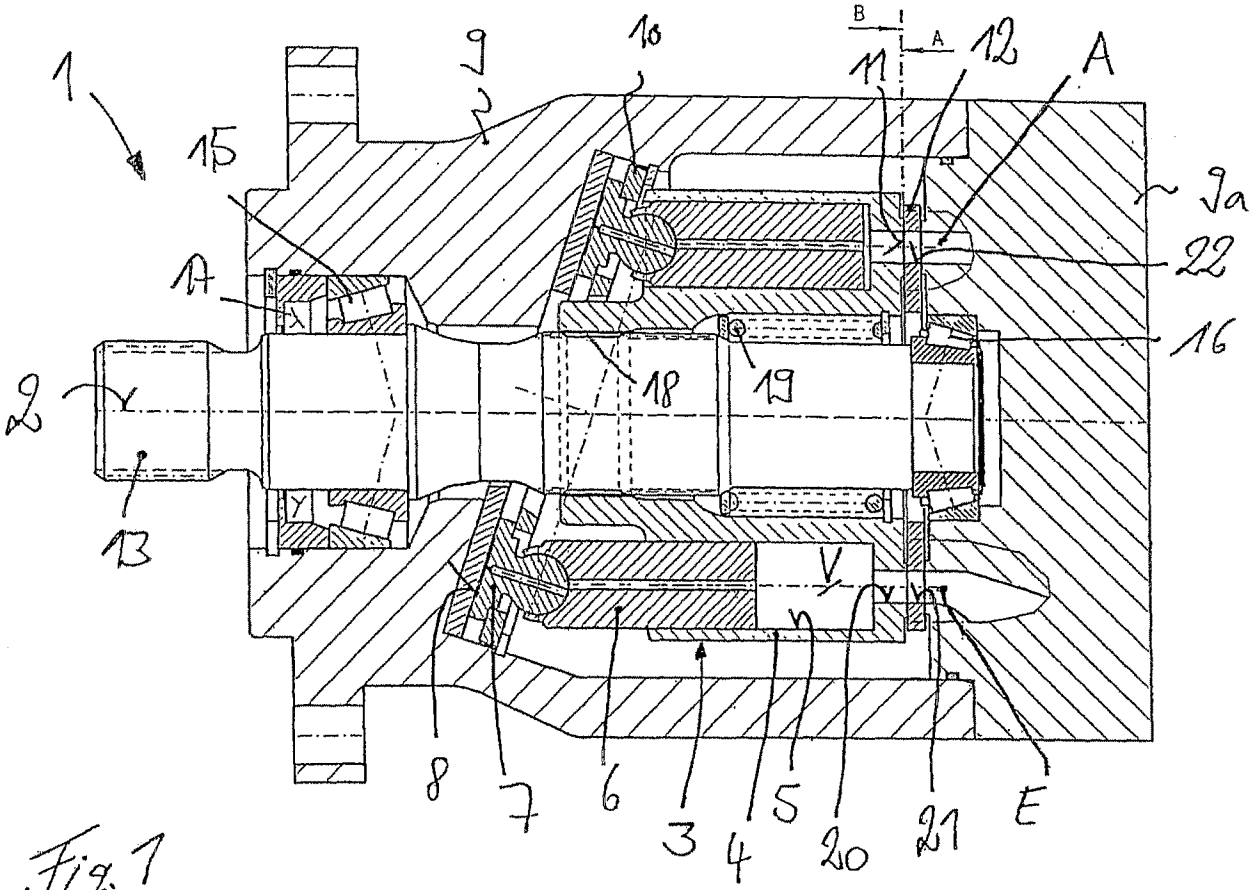
FIG. 1 shows an axial piston machine of the invention in longitudinal section.

FIG. 1 shows a hydrostatic positive displacement machine, such as an axial piston machine 1 utilizing a swash plate construction, for example, in the form of a pump or motor in a longitudinal section.

The axial piston machine 1 has a drive assembly 3 which is positioned so that it can rotate around an axis of rotation 2 and comprises a cylinder drum 4 which is provided with a plurality of piston bores 5 which are arranged concentrically with respect to the axis of rotation 2, which are preferably formed by cylinder bores and in each of which a piston 6 is mounted so that it can be displaced longitudinally.

The pistons 6 are each supported in the area in which they project out of the cylinder drum 4 by means of a support element 7, which can be in the form of a sliding shoe, for example, on a track 8 which is formed by a swashplate. The track 8 is inclined with respect to the axis of rotation and can be molded onto a housing 9 or non-rotationally fastened to it, whereby the axial piston machine 1 has a fixed displacement volume. It is also possible, however, to make the swashplate adjustable in its inclination with respect to the axis of rotation 2, as a result of which the axial piston machine 1 has a variable displacement volume. The support elements 7 formed by the sliding shoes are prevented from lifting up from the track 8 by a hold-down plate 10 which is in the shape of an annular disc and rotates together with the cylinder drum 4. The cylinder drum 4 is supported in the axial direction on a control surface 11 which is affixed to the housing. In the illustrated embodiment, the control surface 11 is on a control plate 12 which is non-rotationally fastened to a housing 9 or a corresponding housing cover 9*a*.

The cylinder drum 4 is penetrated by a central boring, through which a drive shaft 13, which is positioned concentrically in relation to the axis of rotation of the drive assembly 3, is guided through the cylinder drum 4. The drive shaft 13 is rotationally mounted in the housing 9 by means of bearings 15, 16. To provide a seal against the environment, a sealing element 17 such as a shaft gasket, for example, is located in the vicinity of the bearing 15. The cylinder drum 4 is connected so that it is rotationally synchronized but axially movable with respect to the drive shaft 13, for example by means of a drive gearing 18. The drive assembly 3 further comprises a spring 19 which keeps the cylinder drum 4 in contact against the control surface 11.

The axial piston machine 1 has an inlet side E which is formed, for example, by a suction channel in the housing 9, and an outlet side A, which is formed, for example, by a pressure channel in the housing 9. During a rotation of the cylinder drum 4 around the axis of rotation 2, the displacement chambers V formed by the piston bores 4 and the corresponding pistons 6 located in the piston bores 4 come alternately into communication with the inlet side E and the outlet side A.

Figure 2:
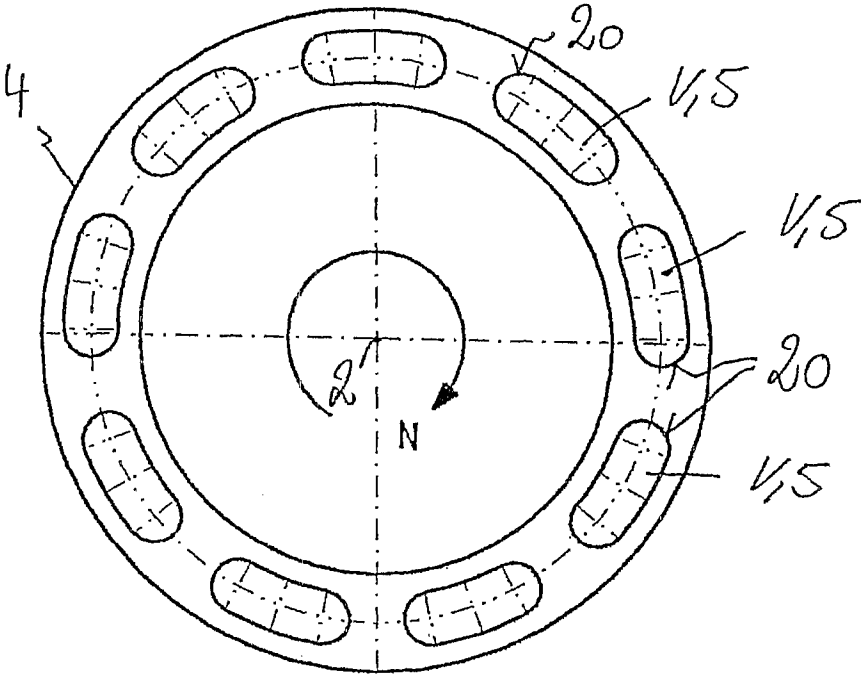
FIG. 2 is a section along view A in FIG. 1.

The piston bores 5 of the cylinder drum 4 are each provided with a connecting opening 20 for the connection with the inlet side E and the outlet side A—as illustrated in further detail in FIG. 2, which is a plan view of the end face of the cylinder drum 4 which is in contact with the control plate 12 and thus the control surface 11. In the illustrated exemplary embodiment, the connecting openings 20 in the end surface of the cylinder drum 4 are each kidney-shaped.

The control plate 12 is provided with kidney-shaped connections 21, 22 for the connection to the inlet side E or to the outlet side A, which connections form control nodules with which the connecting openings 20 in the cylinder drum 4 interact.

Figure 3:
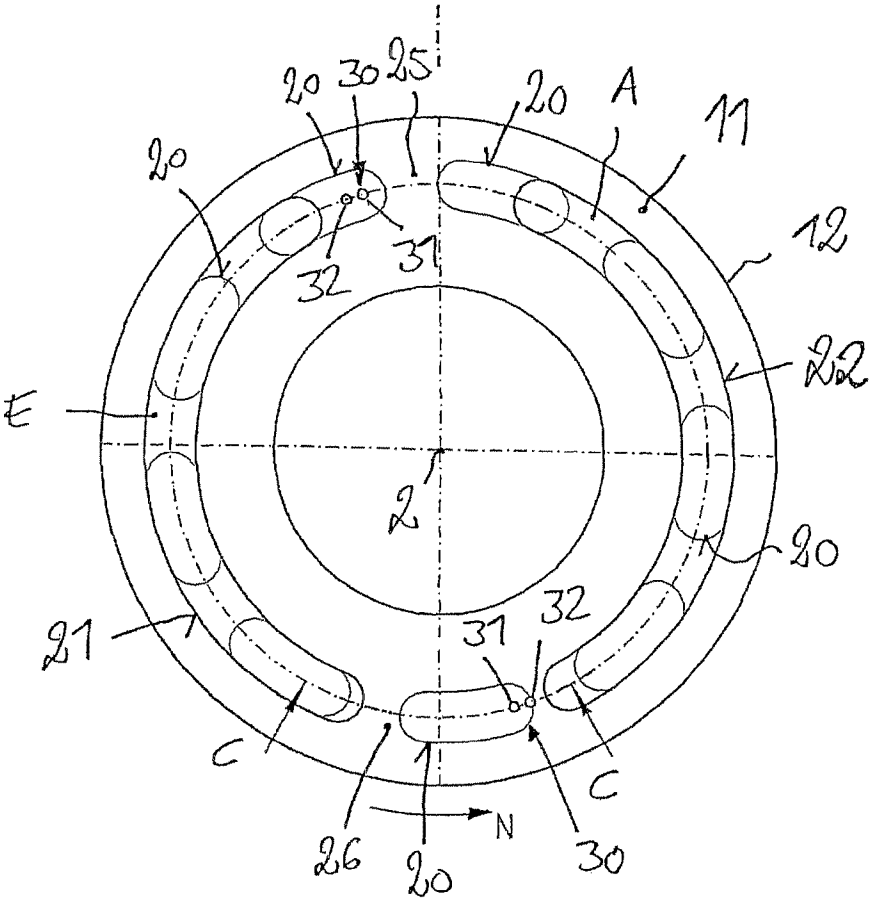
Fig. 3 (Prior Art)
FIG. 3 is a section along the view B in FIG. 1 with an embodiment of a reversing device of the known art.

FIG. 3 is a plan view of the control surface of the control plate 12 with the kidney-shaped connections 21, 22 and the connecting openings 20 of a known axial piston machine 1.

As shown in FIG. 3, the area of the control surface 11 of the control plate 12 between the kidney-shaped connection 21 which is in communication with the inlet side E and the kidney-shaped connection 22 which is in communication with the outlet side A each form a reversing area 25, 26 in the form of a separation web, in which the connecting openings 20 of the cylinder drum 4 are separated from the connections 21, 22. The reversing areas 25, 26 are located in the area of the dead center positions of the movement of the pistons 6.

To achieve an adaptation of the pressure in a displacement chamber V, which as the cylinder drum 4 rotates in the direction indicated by the arrow N and thus as it moves along the reversing area 26 from the inlet side E formed by the suction channel to the outlet side A formed by the pressure channel, to the pressure in the outlet side A, in the reversing area 26 between the connections 21, 22 there is a reversing device 30 on the control surface 11 of the control plate 12. Accordingly, in the reversing area 25 between the connections 21, 22 there is a reversing device 30 on the control surface 11 of the control plate 12, by means of which an adjustment of the pressure in a displacement chamber V to the pressure in the inlet side E can be achieved as the displacement chamber V moves along the reversing area from the outlet side A that forms the pressure channel to the inlet side E that forms the suction channel.

Figure 3B:
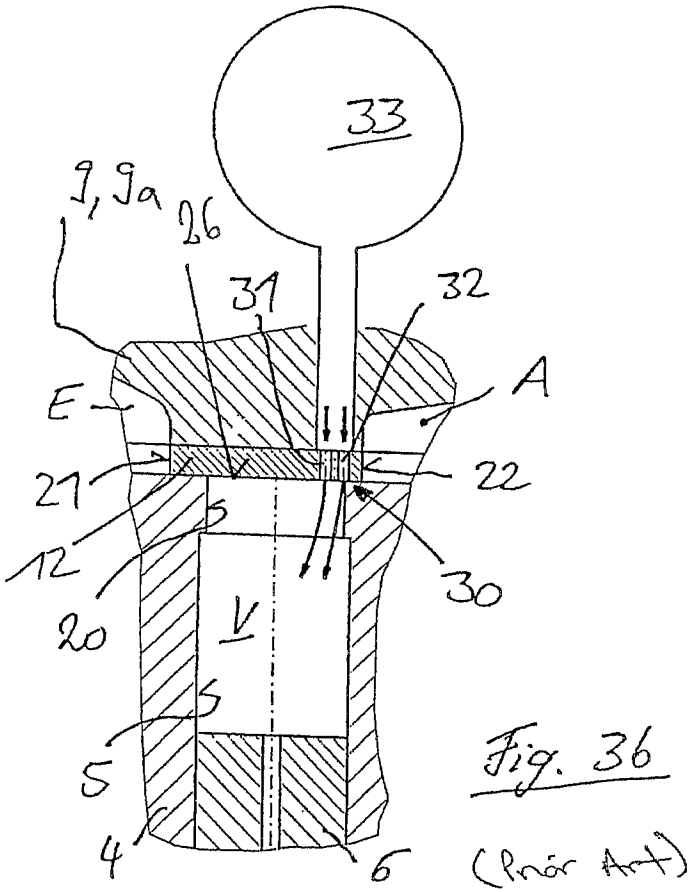
Fig. 3b (Prior Art)
FIGS. 3*a*, 3*b* each are a section along line C-C in FIG. 3 with different realizations of the reversing device of the known art.
Figure 3A:
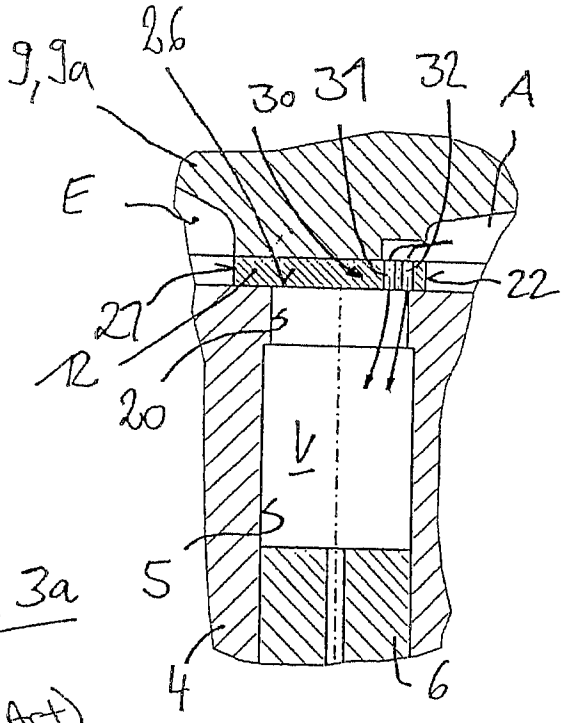
Fig. 3a (Prior Art)

In FIGS. 3*a*, 3*b*, the reversing device 30 of the known art is illustrated in further detail, whereby a development along section line C-C in FIG. 3 in the vicinity of the reversing area 26 is presented in greater detail on a larger scale.

The reversing device 30 has two connecting borings 31, 32 in the form of throttling or nozzle bores which—as is apparent by comparison with FIG. 3—are located on the same reference diameter one behind the other in the peripheral direction and are therefore actuated and opened sequentially one after the other by the connection opening 20 of the displacement chamber V as it moves along the reversing area 26 in the direction of the arrow N. In the embodiment illustrated in FIG. 3*a*, the connecting borings 31, 32 are directly in connection with the outlet side A and thus with the pressure channel in the housing 9. In the embodiment illustrated in FIG. 3*b*, the connecting borings 31, 32 are in communication with a hydraulic buffer 33 which serves as the damping volume.

By means of the connecting borings 31, 32 in the reversing area 26, which form the corresponding circular nozzle cross sections, there is a volume flow out of the outlet side A or out of the hydraulic buffer 33 into the displacement chamber V, to achieve a damped pressure increase in the displacement chamber V. The volume flow via the connecting borings 31, 32 into the displacement chamber V is identified in FIGS. 3*a*, 3*b* by corresponding arrows. As a result of the pressure increase by means of the reversing device 30 in the reversing area 26, high pressure peaks can be prevented during the subsequent connection of the displacement chamber V with the outlet side A, if the connecting opening 20 of the cylinder drum 4, as it continues to move in the direction indicated by the arrow N, comes into communication with the kidney-shaped connection 22 and thus with the pressure channel.

The reversing device 30, in the vicinity of the reversing area 25, has corresponding connecting borings 31, 32 in the form of throttling or nozzle bores, which—as illustrated in FIG. 3 are located on the same reference diameter and one behind the other in the peripheral direction and are therefore actuated and opened one after the other by the connecting opening 20 of the displacement chamber V as it moves along the reversing area 25 in the direction indicated by the arrow N. Analogous to FIG. 3*a*, the connecting borings 31, 32 can be in direct communication with the inlet side E or, analogous to FIG. 3*b*, with a hydraulic buffer 33 which acts as the damping volume.

By means of the connecting borings 31, 32 in the reversing area 25, which form corresponding throttle cross sections, there is a volume flow from the displacement chamber V into the inlet side E or into the hydraulic buffer 33, to achieve a damped pressure decrease in the displacement chamber V. As a result of the pressure decrease by means of the reversing device 30 in the reversing area 25, high pressure peaks as the displacement chamber V subsequently comes into communication with the inlet side E can be prevented, when the connecting opening 20 of the cylinder drum 4, as it continues to move in the direction indicated by the arrow N, comes into communication with the kidney-shaped connection 21 and thus with the suction channel.

A defined cross sectional area of the connecting borings 31, 32 is necessary for the desired pressure control, i.e., the decrease or increase of the pressure in the displacement chamber V, by means of the damped volume flow via the connecting borings 31, 32. Because in the known art as illustrated in FIGS. 3, 3*a*, 3*b*, the connecting borings 31, 32 are actuated and opened one after the other in the direction of movement of the cylinder drum 4 and thus with some delay between their individual openings, the defined cross sectional area is necessary on each connecting boring 30, 31, which means that each of the connecting borings 30, 31 requires a defined diameter.

Since, however, on account of the high volume flows through the connecting borings 31, 32 of the reversing device 30, high volume flows occur which lead to cavitation and cavitation erosion, with the connecting borings 30, 31 of a reversing device 30 of the known art high amounts of material erosion occur on account of the large diameter and cross sectional areas of the connecting borings 30, 31, which are proportional to the square of the cross sectional area of the connecting borings 30, 31 and thus to the fourth power of the diameter of the connecting borings 30, 31, which are in the form of nozzle bores.

FIGS. 4 and 4*a* to 4*d* illustrate a reversing device 30 of the invention. Elements which are identical to those illustrated in FIGS. 3, 3*a* and 3*b* are identified by the same reference numbers.

Figure 4:
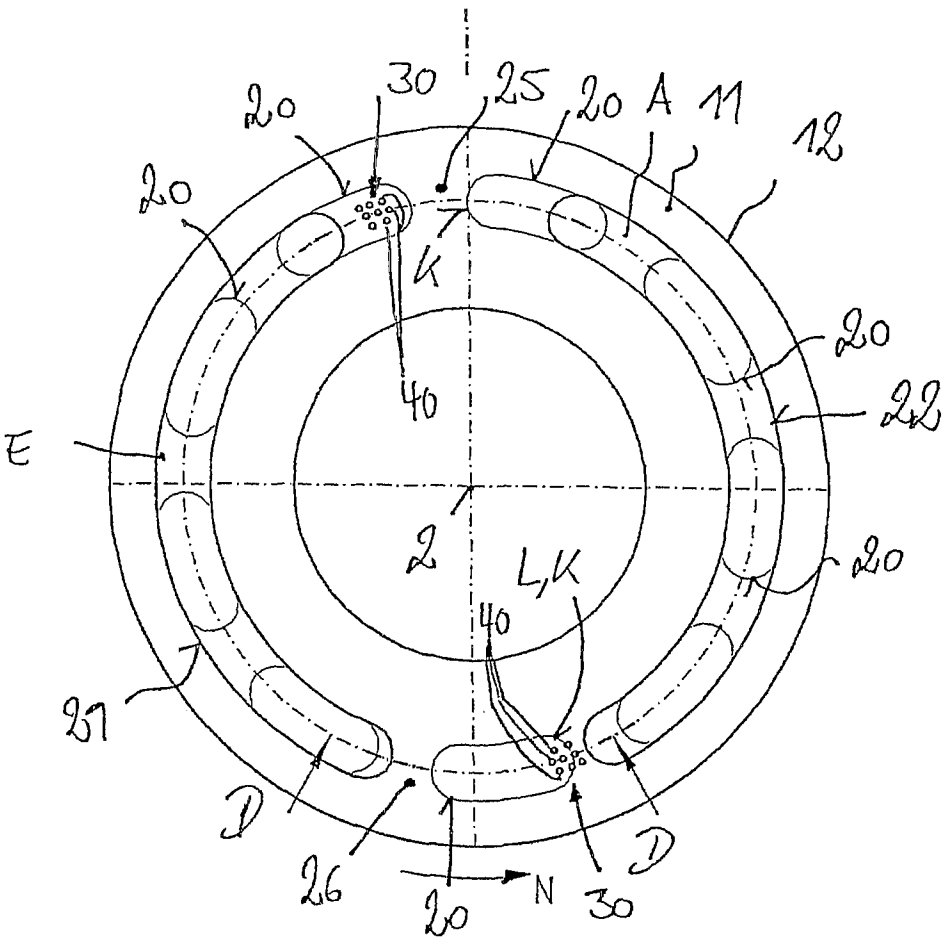
FIG. 4 is a section along the view B in FIG. 1 with a first embodiment of a reversing device of the invention.
Figure 4B:
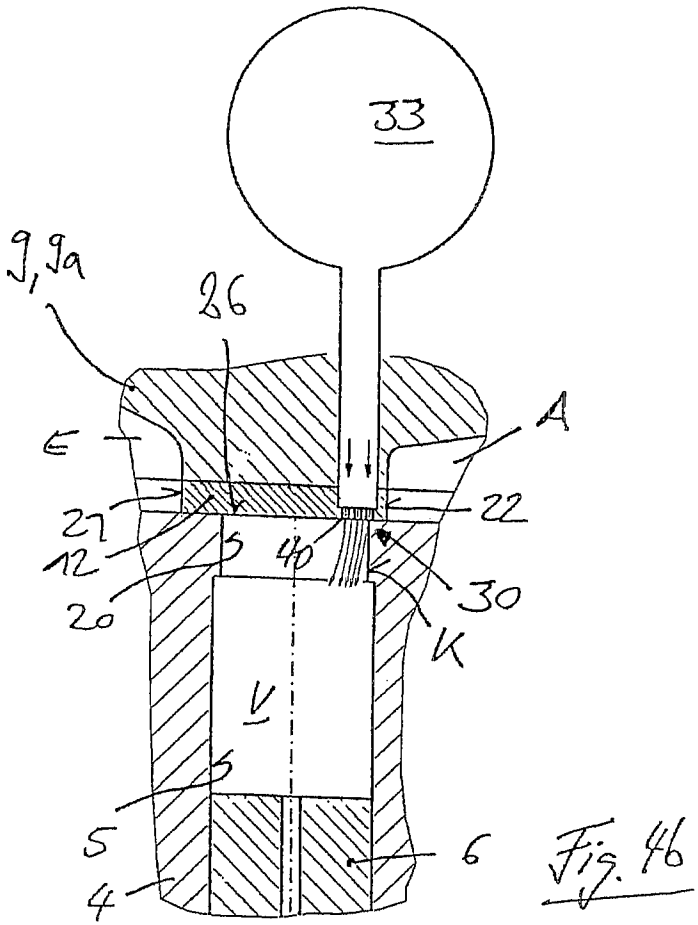
FIGS. 4*a*, 4*b* each are a section along the line D-D in FIG. 4 with different realizations of the reversing device of the invention.
Figure 4A:
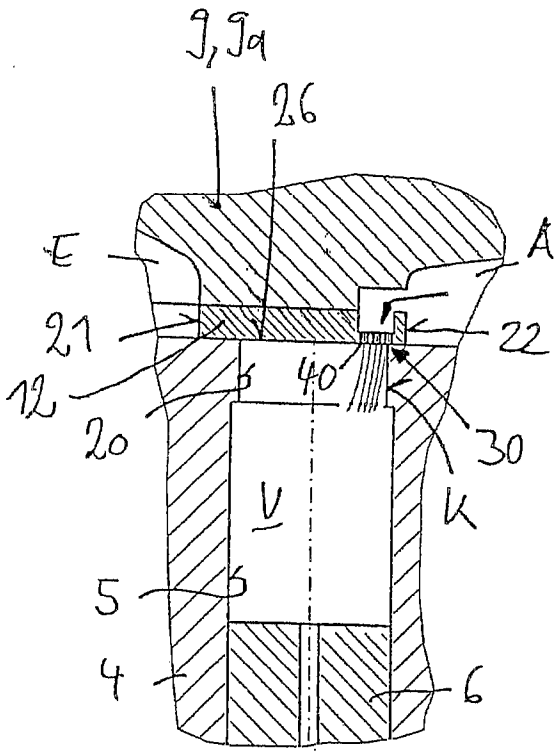
Figure 4D:
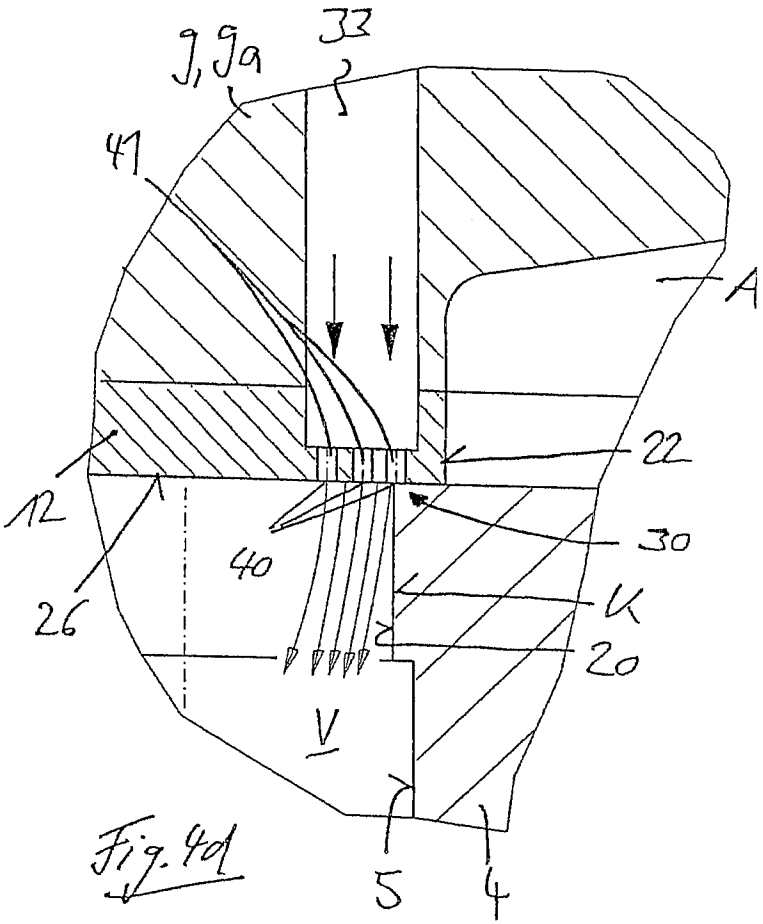
FIGS. 4*c*, 4*d* show a detail of FIGS. 4*a*, 4*b*, respectively, each on an enlarged scale.
Figure 4C:
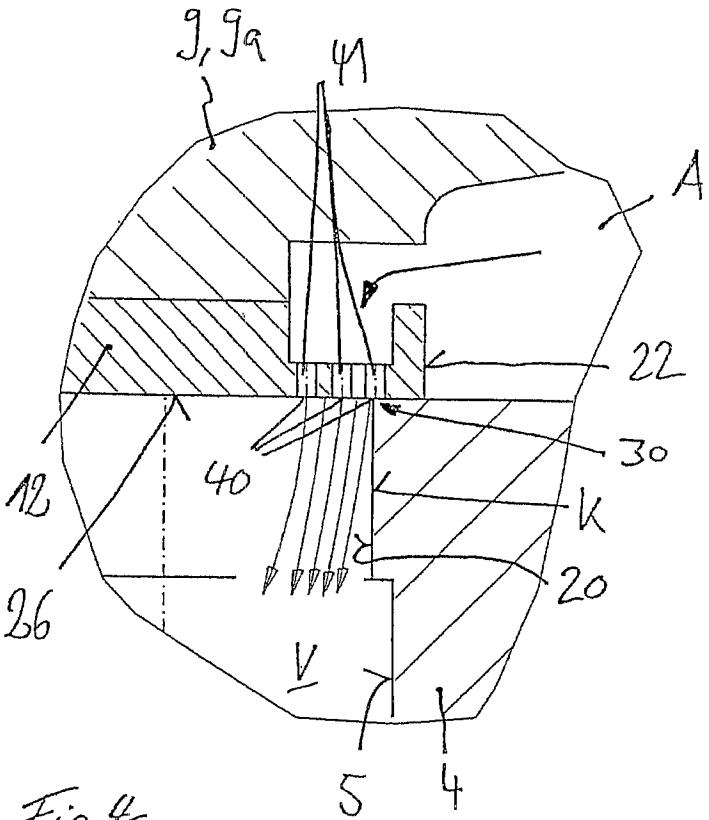

FIG. 4, which is analogous to FIG. 3, shows a plan view of the control surface 11 of the control plate 12 with the kidney-shaped connections 21, 22 and the connecting openings 20 in the cylinder drum 4 of a positive displacement machine of the invention. FIGS. 4*a*, 4*b*, which are analogous to FIGS. 3*a*, 3*b*, illustrate the reversing device 30 in the vicinity of the reversing area 26 in greater detail. A development along section D-D in FIG. 4 is shown on a larger scale and in greater detail. FIG. 4*c* shows a detail of FIG. 4*a* on a larger scale and FIG. 4*d* shows a detail of FIG. 4*b* on a larger scale.

The reversing device 30 of the invention has a plurality of relatively small flow connections 40 which are located on different reference diameters and each of which forms an opening cross section for the damped volume flow into the displacement chamber V or out of the displacement chamber V. In addition, the flow connections 40 are also located one behind another in the peripheral direction.

On account of the arrangement of the flow connections 40 on different reference diameters, at least two flow connections 40 lie on a contour line L which corresponds to the leading edge K of the connecting opening 20 of the cylinder drum 4 in the direction of movement indicated by the arrow N, so that during the movement of the connecting opening 20 along the reversing area 25 or 26, at least two flow connections 40 are actuated and opened simultaneously, i.e., in the same angular position of the cylinder drum, by the leading edge K of the connecting opening 20.

In the invention, therefore the cross sectional area of the reversing device 30 necessary for a damped volume flow via the reversing device 30 and therefore for a desired pressure control, i.e. pressure increase or pressure decrease, in the displacement chamber V is divided into a plurality of flow connections 40, each of which has a relatively small opening cross section and, as a function of the number of the plurality of flow connections, presents a total cross sectional area which equals the required cross sectional area for the desired pressure control.

On account of the increase in the number of flow connections 40 actuated simultaneously, the cross sectional area of the individual flow connections 40 can therefore be reduced. Because the material erosion caused by cavitation is inversely proportional to the number of flow connections 40, the reversing device 30 of the invention achieves a reduction of cavitation erosion and a reduction of cavitation noise.

FIGS. 4, 4*a* to 4*d* show the individual flow connections 40 of the reversing device 30, each in the form of nozzle bores 41, which are realized in the control plate 12 and empty into the control surface 11.

As shown in the exemplary embodiment illustrated in FIGS. 4*a* and 4*c*, the individual flow connections 40 are in communication with the outlet side A. In the exemplary embodiment illustrated in FIGS. 4*b* and 4*d*, the individual flow connections 40 are in communication with a hydraulic buffer 33 which acts as a damping volume.

In the exemplary embodiment illustrated in FIG. 4, there are eight flow connections. It goes without saying, however, that the reversing device 30 of the invention can have a variable number of flow connections with a higher or lower number of flow connections. For example, four flow connections can be provided, two of which are located on different reference diameters on a contour line L, and are therefore actuated and opened simultaneously by the leading edge K of the connecting opening 20, and the two additional flow openings in the direction of rotation indicated by the arrow N are actuated and opened before or after the two flow connections. These two additional flow connections can also be located on different reference diameters on a contour line L and are therefore actuated and opened simultaneously by the leading edge K of the connecting opening 20.

During the movement of the connecting opening 20 over the reversing area 25, 26, the opening cross sections formed by the individual flow connections 40 are therefore opened simultaneously as the connecting opening 20 moves over the reversing area 25, 26, and sequentially and therefore with a delay in the direction of movement of the cylinder drum 4.

Figure 5:
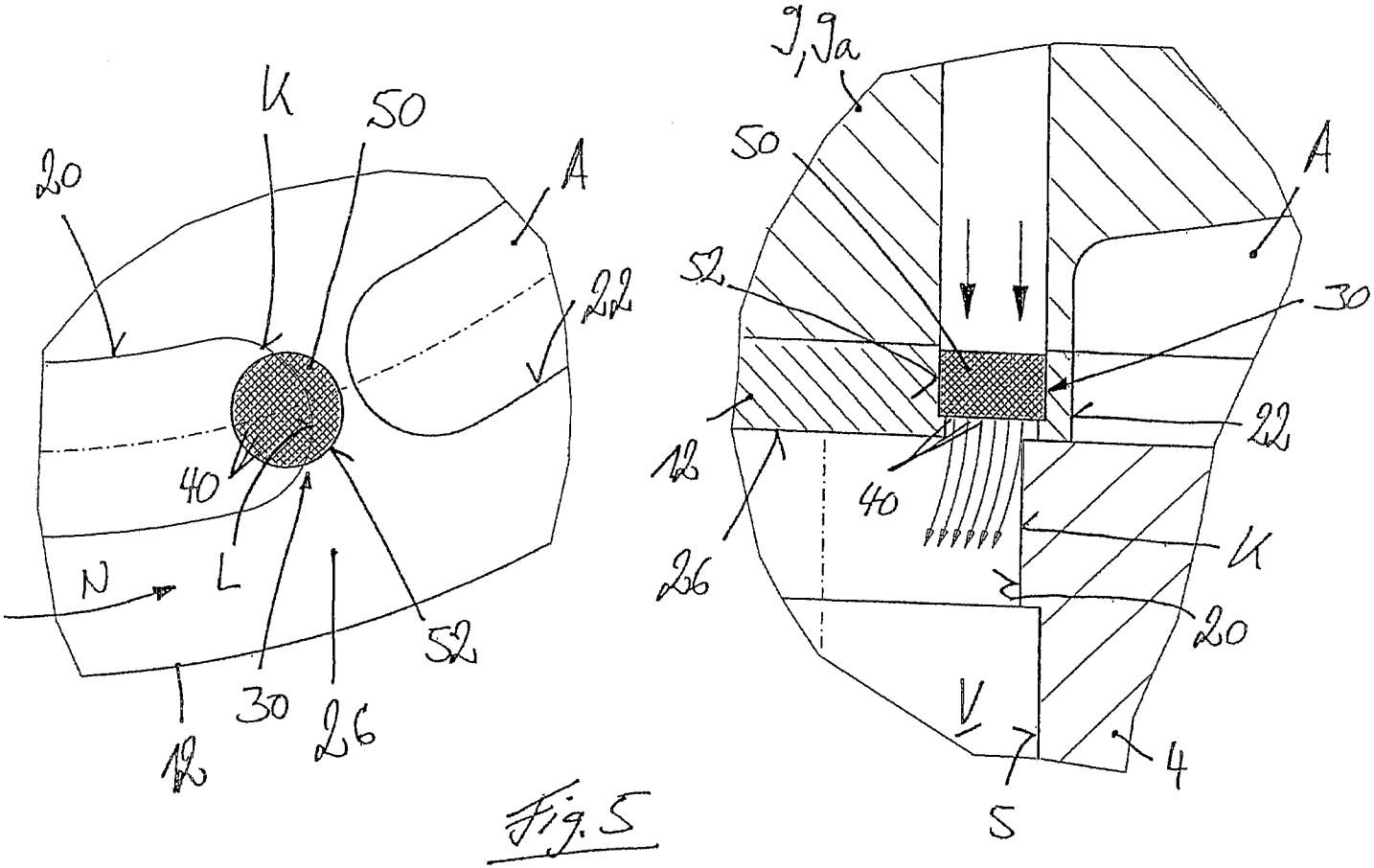
FIG. 5 a second embodiment of a reversing device of the invention.

FIG. 5 illustrates a second exemplary embodiment of the invention in which the reversing device 30 comprises a high-porosity material 50 with a plurality of pores, whereby each of the individual pores forms a flow connection 40. The volume flow for the pressure equalization of the displacement chamber V is guided through the high-porosity material 50 into the displacement chamber V or out of the displacement chamber V. The high-porosity material 50 is advantageously in the form of an open-pore metal foam such as a sinter material. The pores of such a high-porosity material 50 are formed by the spaces in the material, each of which acts like an individual small opening cross section and thus flow connections 40.

The high-porosity material 50 is in the form of an insert, such as a cylindrical insert, which is located and fastened in a boring 52 in the control plate 12.

Figure 6:
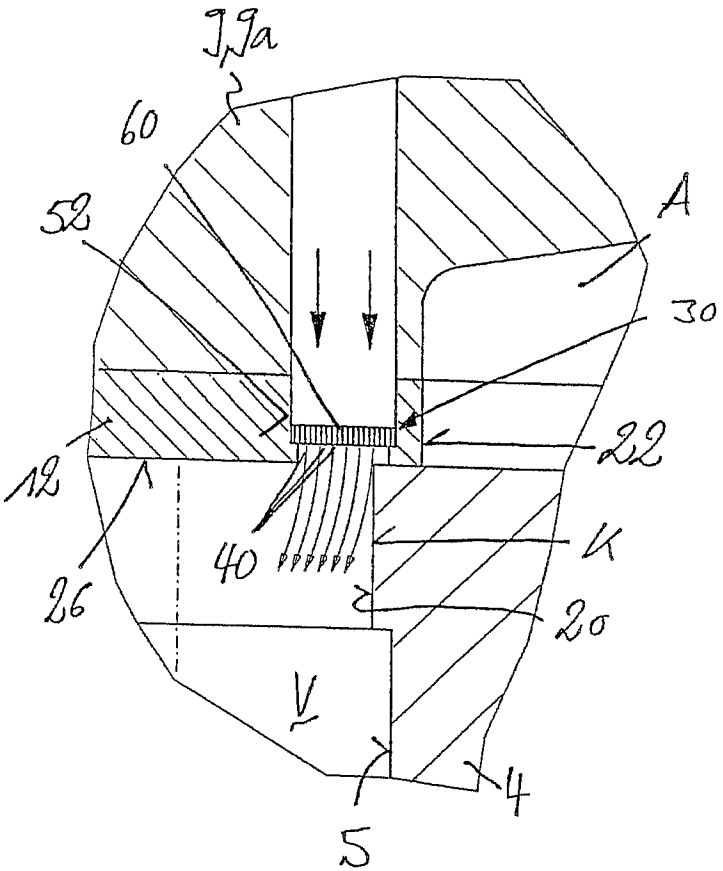
FIG. 6 a third embodiment of a reversing device of the invention.
Figure 6:
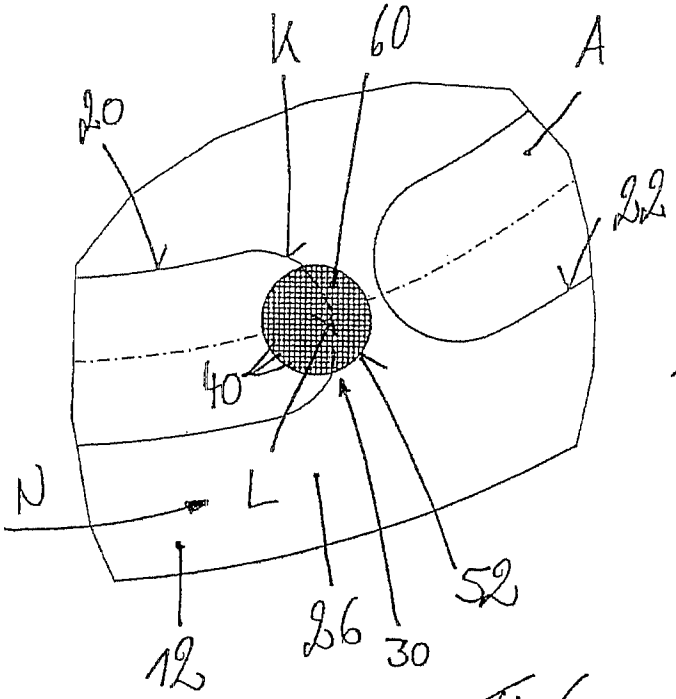

FIG. 6 illustrates an additional embodiment of the invention in which the reversing device 30 comprises a screen-like or grid-like structure 60 with a plurality of pores, whereby the individual pores each form a flow connection 40.

The screen-like or grid-like structure 60 can be formed by a fabric, such as a mesh fabric for example. The screen-like or grid-like structure 60 can also be formed by a flat plate provided with perforations. The perforations can be introduced into the plate by means of a laser process.

The screen-like or grid-like structure 60, analogous to FIG. 5, is advantageously in the form of a cylindrical insert, which is located and fastened in a boring 52 in the control plate 12.

With the high-porosity material 50 in FIG. 5 or the screen-like or grid-like structure 60 in FIG. 6 with the plurality of pores, as the cylinder drum 4 moves across the reversing area 25, 26, a plurality of flow connections 40, each formed by an individual pore, lies on a contour line L which corresponds to the leading edge K of the connecting opening 20 so that a plurality of pores are simultaneously actuated and opened by the leading edge K. In addition, other pores and thus additional flow connections are actuated and opened sequentially during the movement of the connecting opening 20. With the high-porosity material 50 in FIG. 5 or the screen-like or grid-like structure 60 in FIG. 6, it is therefore easily possible for a plurality of flow connections 40 and opening cross sections formed by the pores to be opened simultaneously as the connecting opening 20 moves over the reversing area 25, 26, and to be opened sequentially and therefore with some delay as the connecting opening 20 moves over the reversing area 25, 26 in the direction of movement of the cylinder drum 4.

In the embodiments illustrated in FIG. 5 or 6, the reversing device 30 can be in direct communication with the outlet side A or the inlet side E or a hydraulic buffer of 33 which acts as the damping volume.

Figure 7:
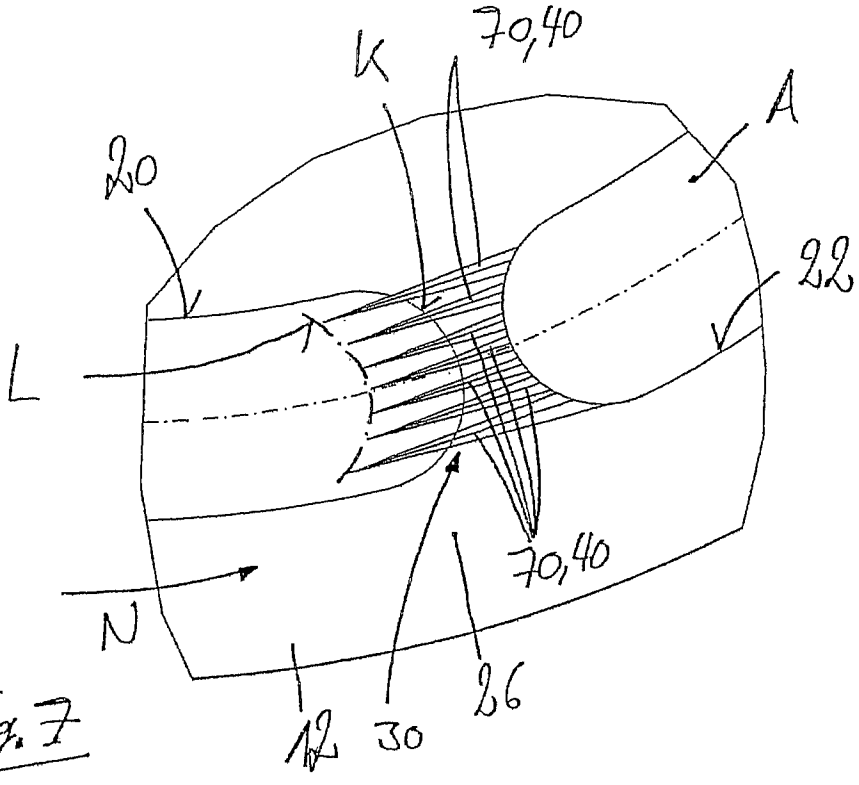
FIG. 7 a fourth embodiment of a reversing device claimed by the invention.

FIG. 7 illustrates an additional embodiment of the invention, in which the individual flow connections 40 are in the form of throttle notches 70 in the control surface 11 of the control plate 12 and extend from the reversing area 25 or 26 to the connection 22 or 21 and thus to the outlet side A or the inlet side E. The throttle notches 70 are located on different reference diameters in the radial direction. The tips of the throttle notches 70 lie on the contour line L which corresponds to the leading edge K of the connecting opening 20 of the cylinder drum 4, so that the throttle notches 70 are actuated and opened simultaneously by the leading edge K of the connecting opening 20 as it moves in the direction indicated by the arrow N along the reversing area 25 or 26 toward the connection 21 or 22.

The reversing device 30 of the invention with a plurality of flow connections 40 as illustrated in FIGS. 4 to 7 can be located in the reversing area 25 and/or in the reversing area 26.

The positive displacement machine can be in the form of a pump in which the inlet connection E is in the form of a suction channel and the outlet connection A is in the form of a pressure channel. The displacement machine can also be in the form of a motor, in which the inlet connection E is in the form of a pressure channel and the outlet connection A is in the form of a suction channel.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic positive displacement machine, comprising:

a cylinder drum located in a housing and rotatable around an axis of rotation, wherein the cylinder drum is provided with at least one piston bore;

a longitudinally displaceable piston located in the piston bore, wherein during rotation of the cylinder drum the piston bore is placed in alternating communication with an inlet side and an outlet side, wherein the inlet side and outlet side comprise connections to a control plate; and a reversing device located in a reversing area between the connections on the control plate and which, by means of a volume flow into or out of a displacement chamber formed by the piston and the piston bore, damps a pressure adjustment between the displacement chamber and a pressure present in the connections of the inlet side and the outlet side, wherein the reversing device comprises at least two flow connections which are actuated simultaneously by the displacement chamber as it moves along the reversing area, wherein all of the at least two flow connections on the control plate are located on a same contour line at a specific instant during movement of the displacement chamber, the contour line corresponding to a leading edge of a connecting opening of the displacement chamber, and wherein the flow connections are located on different reference diameters on the control plate in a radial direction relative to the contour line such that the displacement chamber, as it moves along the control plate, opens all of the flow connections on the contour line simultaneously with a leading edge of a connecting opening of the displacement chamber.

2. The hydrostatic positive displacement machine as recited in claim 1, wherein the flow connections are each in the form of a throttle notch.

3. The hydrostatic positive displacement machine as recited in claim 1, wherein the flow connections are in communication with the inlet side.

4. The hydrostatic positive displacement machine as recited in claim 1, wherein the flow connections are in communication with the outlet side.

5. The hydrostatic positive displacement machine as recited in claim 1, wherein the flow connections are in communication with a hydraulic buffer.

6. The hydrostatic positive displacement machine as recited in claim 1, wherein the positive displacement machine is an axial piston machine.

7. The hydrostatic positive displacement machine as recited in claim 1, wherein the positive displacement machine is selected from a pump or motor.

* * * * *